US012680032B2

(12) United States Patent
Risbjerg Jarlkov et al.

(10) Patent No.: US 12,680,032 B2
(45) Date of Patent: Jul. 14, 2026

(54) HALIDES REMOVAL WASHING SYSTEM FOR A HYDROCARBON STREAM

(71) Applicant: Haldor Topsøe A/S, Kgs. Lyngby (DK)

(72) Inventors: Klaus Risbjerg Jarlkov, Køge (DK); Lars Jørgensen, Kgs. Lyngby (DK)

(73) Assignee: Topsoe A/S, Kgs. Lyngby (DK)

( * ) Notice: Subject to any disclaimer, the term of this patent is extended or adjusted under 35 U.S.C. 154(b) by 265 days.

(21) Appl. No.: 17/641,697

(22) PCT Filed: Oct. 28, 2020

(86) PCT No.: PCT/EP2020/080240
§ 371 (c)(1),
(2) Date: Mar. 9, 2022

(87) PCT Pub. No.: WO2021/094086
PCT Pub. Date: May 20, 2021

(65) Prior Publication Data

US 2022/0298428 A1 Sep. 22, 2022

(30) Foreign Application Priority Data

Nov. 13, 2019 (EP) ..... 19208793

(51) Int. Cl.

| | |
|---|---|
| ***C10G 31/00*** | (2006.01) |
| ***C10G 31/08*** | (2006.01) |
| ***C10G 70/06*** | (2006.01) |
| ***C10K 1/10*** | (2006.01) |
| *C10G 49/00* | (2006.01) |

(52) U.S. Cl.
CPC ..... *C10G 31/08* (2013.01); *C10G 70/06* (2013.01); *C10K 1/101* (2013.01); *C10G 49/005* (2013.01); *C10G 2300/202* (2013.01); *C10G 2300/805* (2013.01)

(58) Field of Classification Search
CPC ..... C10K 1/101; C10G 31/08; C10G 49/005; C10G 70/06; C10G 2300/202; C10G 2300/805
See application file for complete search history.

(56) References Cited

U.S. PATENT DOCUMENTS

| | | | | |
|---|---|---|---|---|
| 3,847,564 | A | 11/1974 | Marion et al. | |
| 4,169,279 | A | 9/1979 | Friedman et al. | |
| 4,247,367 | A | 1/1981 | Reilly | |
| 5,061,408 | A | 10/1991 | Hüning et al. | |
| 6,200,438 | B1 * | 3/2001 | Clasen | C25B 9/00 204/279 |
| 7,553,356 | B2 | 6/2009 | Rikihisa | |
| 9,003,802 | B2 | 4/2015 | Hernandez et al. | |
| 9,937,467 | B2 | 4/2018 | Keneshiro et al. | |

(Continued)

FOREIGN PATENT DOCUMENTS

| | | | |
|---|---|---|---|
| CN | 107019980 | A | 8/2017 |
| DE | 10 2006 001 318 | A1 | 7/2007 |

(Continued)

*Primary Examiner* — Prem C Singh
*Assistant Examiner* — Brandi M Doyle
(74) *Attorney, Agent, or Firm* — Blank Rome LLP

(57) ABSTRACT

A halides removal washing system for absorbing halides from a process gas within a process gas duct comprising a wash water injection nozzle and anti-precipitation means arranged around the nozzle, injection pipe and within the process gas duct.

6 Claims, 2 Drawing Sheets

(56) References Cited

U.S. PATENT DOCUMENTS

| | | | | |
|---|---|---|---|---|
| 2005/0013755 | A1 | 1/2005 | Higgins | |
| 2006/0289290 | A1* | 12/2006 | Girault | B01D 53/685 204/157.3 |
| 2010/0005787 | A1* | 1/2010 | Hosoya | F01N 11/002 60/297 |
| 2010/0116900 | A1* | 5/2010 | Wurz | B05B 7/045 239/8 |
| 2016/0168719 | A1* | 6/2016 | Chuyko | F16L 58/181 427/236 |
| 2017/0320012 | A1 | 11/2017 | Kaneshiro et al. | |
| 2017/0368501 | A1 | 12/2017 | Codoluto et al. | |

FOREIGN PATENT DOCUMENTS

| | | | |
|---|---|---|---|
| EP | 1 117 637 | A1 | 7/2001 |
| GB | 1063297 | A | 3/1967 |
| JP | H09855 | A | 1/1997 |
| JP | H09192447 | A | 7/1997 |
| JP | 2003260333 | A | 9/2003 |
| JP | 2006110408 | A | 4/2006 |
| JP | 2006232904 | A | 9/2006 |
| JP | 5952984 | B1 | 7/2016 |
| KR | 2017-0065595 | A | 6/2017 |
| RU | 2539223 | C2 | 11/2013 |
| WO | WO 00/18728 | A1 | 4/2000 |
| WO | WO 2009/040246 | A1 | 4/2009 |
| WO | WO 2015/050635 | A1 | 4/2015 |

* cited by examiner

HALIDES REMOVAL WASHING SYSTEM FOR A HYDROCARBON STREAM

FIELD OF THE INVENTION

This invention relates to a system for conversion of a hydrocarbonaceous feed wherein an amount of the converted feed may solidify, and specifically a system for removing halides from a hydrocarbon stream comprising one or more halides.

BACKGROUND OF THE INVENTION

Refinery processes comprise a plurality of treatments of hydrocarbon rich streams in order to provide products in the form of gasoline, diesel, etc. Such treatments comprise hydro-treatment, hydro-cracking, fractionation and stripping, as well as intermediate heat exchange and removal of impurities.

Some of the hydrocarbon rich streams to be processed in the refinery comprises halides, e.g. comprising chlorine. Halides are unwanted in the product(s) and are also disadvantageous within the refinery plant due to corrosion issues within the units of the plant.

In addition to halides, other heteroatoms are also present in the treated hydrocarbons, e.g. nitrogen. During hydrotreatment organically bound nitrogen may be released as ammonia. Ammonia and halides may react to form salts, e.g. ammonium chloride, which is a solid at temperatures below 270° C. Precipitation of such salts may result in partial or complete blocking of process lines and must therefore be avoided. Therefore, it is important to ensure the process temperature to be above 270° C.

Typically, the hydrotreatment reactions are exothermal, and therefore it is possible to optimize the energy consumption of the process, by heat exchange between feed and effluent. If ammonia and halides are present a problem in this respect is however that in a feed/effluent heat exchanger feed temperatures below 270° C. may result in cold zones in the heat exchanger, where e.g. ammonium chloride may precipitate.

According to the present invention a halides removal washing system is described, which is able to absorb halides from a process gas stream with a wash water injected into the process gas stream by means of an injector pipe and nozzle.

WO 2015/050635 relates to a process for removing sulfur and halides from a hydrocarbon stream by hydrotreatment. The document is silent on the presence of nitrogen in the intermediate stream, and contrary to the present disclosure it explicitly recommends recuperation of heat from the hydrotreated product by heat exchange with chilled water, which is highly likely to cause precipitation of salts, if nitrogen was present.

BRIEF SUMMARY OF THE INVENTION

The halides removal washing system of the invention comprises a process gas duct suited for conduction of a process gas comprising halides. The system also comprises an injector pipe extending into the process gas duct. The injector pipe has a wash water inlet in a first end arranged outside the process gas duct and a wash water outlet with an injector nozzle in a second end of the injector pipe arranged within the process gas duct. The injector nozzle is adapted to spray the wash water into the process gas in the process gas duct downstream of the injector nozzle to absorb halides from the process gas.

The halides removal washing system of this invention when used in a process gas duct with process gas comprising halides has the advantages that it ensures that $NH_4Cl$ will not precipitate on any surfaces when operated properly. Thermal stress on pressure bearing parts at injection is avoided by the mechanical design as it will be explained in more details in relation to the figures. The mixing of wash water and feed ensures washout of HCl above 99.9%.

In an embodiment of the invention the system comprises anti-precipitation means arranged around at least a part of the injector pipe which extends into the process gas duct. It is to be understood that anti-precipitation means are means which helps ensure that the surface of the injector pipe will not be cold relative to the process gas. If the surface of the injector pipe is relative cold compared to the process gas around it, there is a risk that parts of the process gas will precipitate on the surface of the injector pipe, which may lead to corrosion. The anti-precipitation means may for example be heating means or insulation.

In a further embodiment anti-precipitation means are arranged around at least a part of the injector nozzle. It is especially beneficial to provide the injector pipe and the injector nozzle with anti-precipitation means, since these members may otherwise provide relative cold surfaces on which there is a high risk of precipitation of parts of the process gas.

The anti-precipitation means may be in form of heat insulation. In a further embodiment the anti-precipitation means may be an injector purge channel adapted to provide a relative hot purge fluid compared to the temperature of the wash water. In a further embodiment, the anti-precipitation means may be a heat tracing, e.g. electrical heating wiring, an electrical wiring which can heat up the surfaces of the injector nozzle and the injector pipe when an electrical current is sent through the electrical wiring.

The effects of the heat insulation, the purge channel, heat tracing and further anti-precipitation means is avoidance of precipitation on surfaces which otherwise would be relative cold as compared to the process gas.

In an embodiment of the invention, the process gas duct has an anti-corrosion liner arranged on the inside surface of the process gas duct downstream of the injector nozzle. In an embodiment, this anti-corrosion liner may be arranged adjacent to the inside surface of the process gas duct, leaving a gap between the inside surface of the process gas duct and the anti-corrosion liner. This gap allows for a purge fluid to flow between the anti-corrosion liner and the process gas duct. The gap may in one embodiment be in the range of 0.2-50 mm. Furthermore, a sealing may be provided between the anti-corrosion liner and the process gas duct for the process gas not to enter the gap and for controlled flow of the purge gas. Also, a purge fluid connection to the process gas duct downstream of the injector nozzle may be provided, which is adapted to purge fluid into the gap.

In an embodiment of the invention one or more mixers are arranged within the process gas duct downstream of the injector nozzle to provide mixing of the process gas.

In a further embodiment of the invention, not only one but a plurality of injector pipes and a plurality of injector nozzles are provided. The plurality of injector pipes and -nozzles may be arranged within a single process gas duct or there may also be a plurality of process gas ducts, each with one or more injector pipes and -nozzles. The plurality of process gas ducts may all be connected to a common process gas duct upstream of the injector nozzles in a manifold setup.

As mentioned in the above, the described halides removal washing system may be used in a hydrotreatment process.

Throughout this text, the term "Organic halides" are chemical compounds in which one or more carbon atoms are linked by covalent bonds with one or more halogen atoms (fluorine, chlorine, bromine, iodine or astatine—group 17 in current IUPAC terminology). "Inorganic halides" are chemical compounds between a halogen atom and an element or radical that is less electronegative (or more electropositive) than the halogen, to make a fluoride, chloride, bromide, iodide, or astatine compound, with the further limitation that carbon is not part of the compound.

The term "removing halides" is meant to include situations where either some of the halides present or all of the halides present is removed. The term is thus not limited to situation where a certain percentage of the halides present are removed.

The system disclosed may be found useful where the feed is a waste product comprising halides, such as direct hydrotreatment of waste plastic or hydrotreatment of the product from pyrolysis of waste plastic. The feed may also originate from algae lipids, grown in salt water, or other biological feeds comprising hydrocarbons and chloride.

An example of the halides removal washing system will be explained in more detail in the following with reference to the figures.

POSITION NUMBERS

01. Process gas duct.
02. Injector pipe.
03. Injector nozzle.
04. Injector connection flange.
05. Heat insulation.
06. Injector purge channel.
07. Heat tracing.
08. Duct liner.
09. Duct sealing.
10. Mixing element.
11. Duct purge.

DETAILED DESCRIPTION OF THE FIGURES

Figure 1:
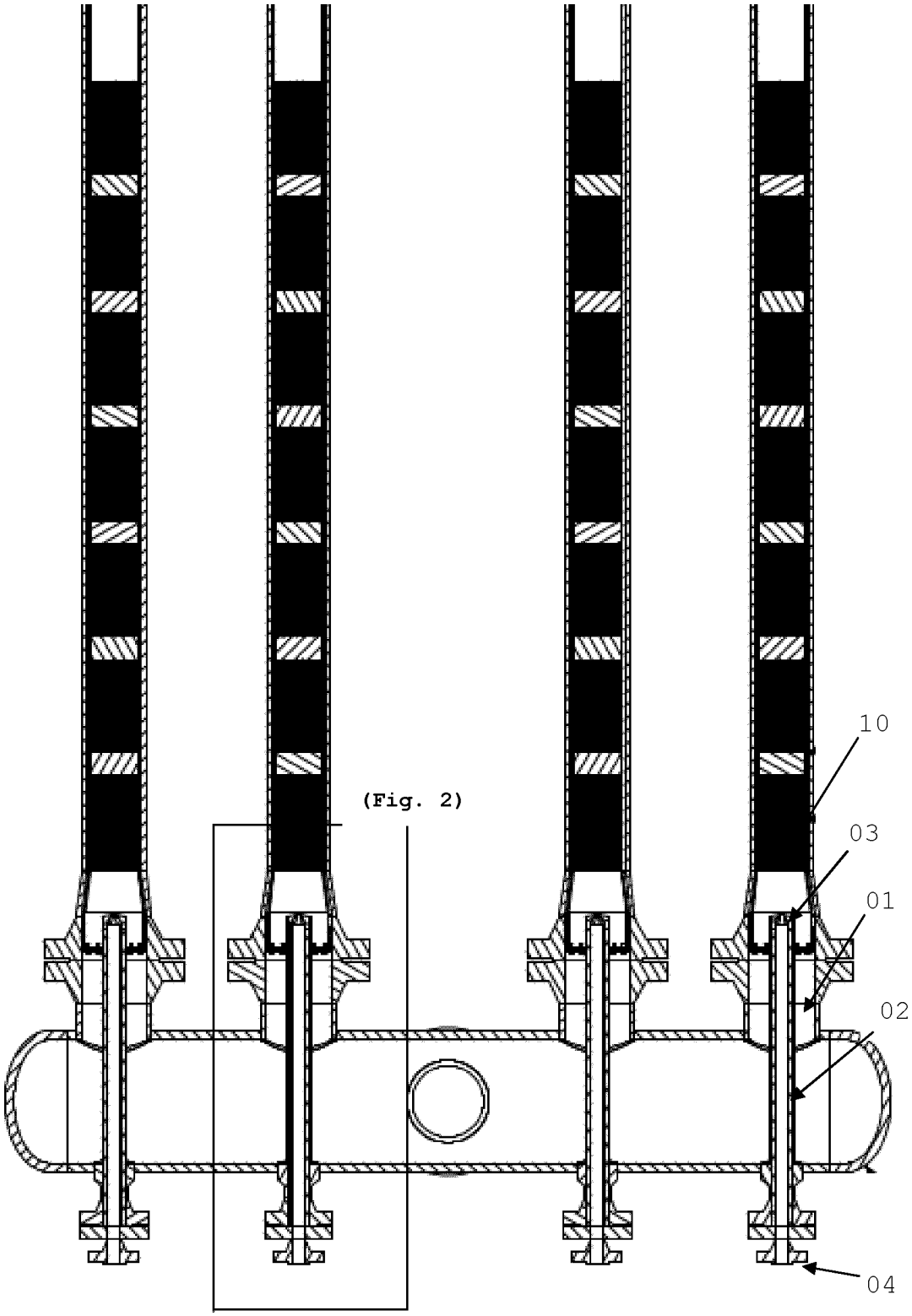
FIG. 1 shows an overview of a halides removal washing system.

FIG. 1 shows an overview of a halides removal washing system according to an embodiment of the invention. In this embodiment a manifold solution is used, with a plurality, in this case four process gas ducts 01 connected to a common process gas duct. For simplicity, only one of the process gas ducts has position numbering, it is to be understood, that the other three process gas ducts comprise similar components with the like position numbers. Within each of the process gas ducts an injector pipe 02 is arranged through the common process gas duct, upstream and within the process gas duct downstream of the common process gas duct. At a first end of the injector pipe, an injector connection flange 04 provides for a wash water inlet. At the second end of the injector pipe an injector nozzle 03 is arranged in fluid connection to the injector pipe and the injector connection flange. The injector nozzle is adapted to spray a wash water into the process gas stream flowing in the process gas duct. Downstream the injector nozzle and within the process gas duct a number of mixing elements 10 are arranged in series to provide mixing of the process gas.

Figure 2:
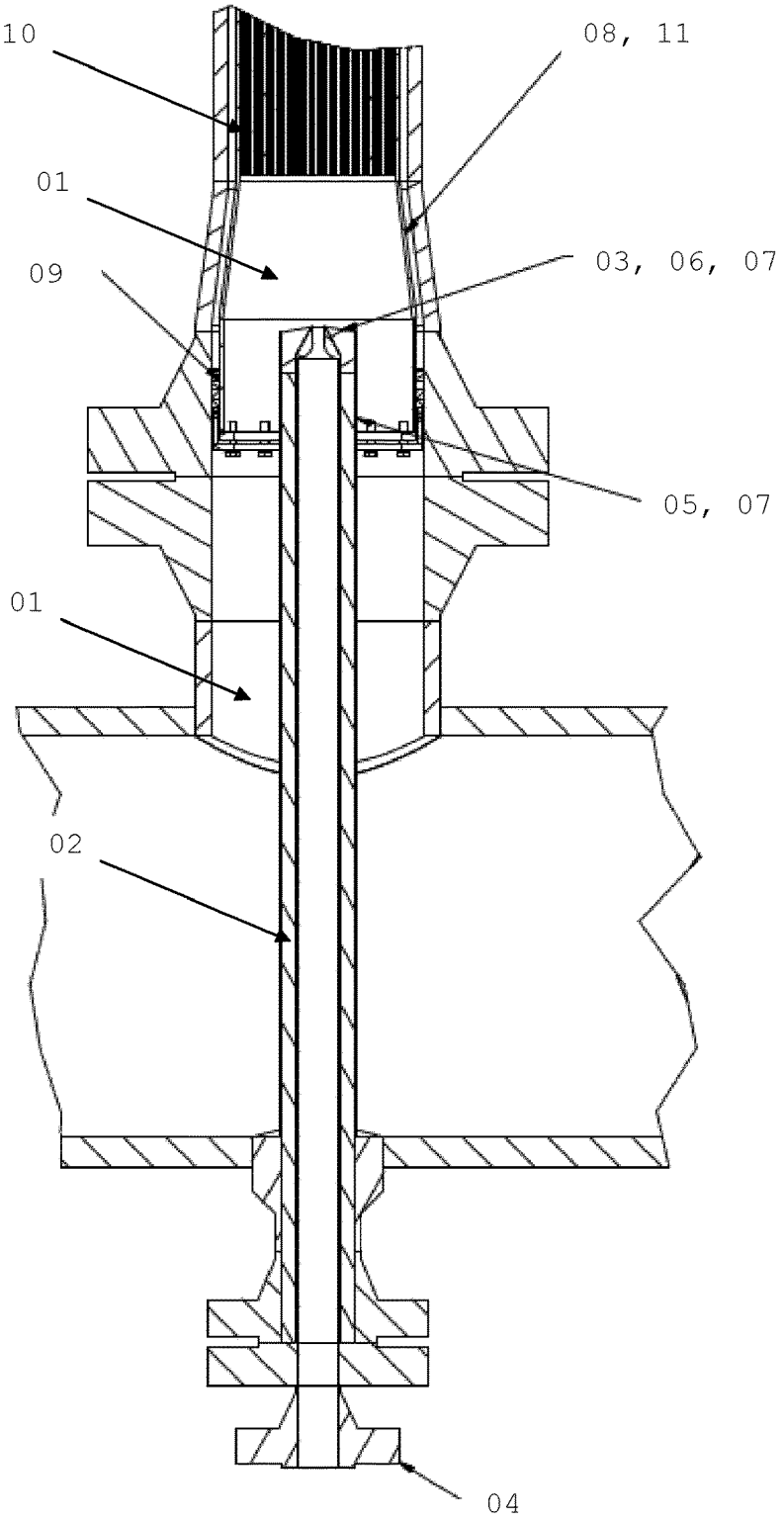
FIG. 2 shows a detailed view of a part of a halides removal system.

In FIG. 2 the part of the halides removal washing system with the injector pipe and -nozzle is shown in more detail. In this larger view, it can be seen that injector pipe is provided with both a heat insulation 05 and a heat tracing 07 to prevent any precipitation of the relative hot process gas on the injector pipe with the relative cold wash water. Also, the injector nozzle has a heat tracing and it further has an injector purge channel 06 around the nozzle also to prevent precipitation of the relative hot process gas.

The process gas duct has a duct liner 08 arranged within, adjacent to the inner surface of the process gas duct, starting a little upstream of the injector nozzle and stretching downstream of the injector nozzle. The liner is arranged with a gap between the liner ant the inner surface of the process gas duct, thereby allowing for a duct purge 11 fluid flow. To control this purge fluid flow, a duct sealing 09 is arranged at the start of the liner upstream, between the liner and the inner surface of the process gas duct.

The invention claimed is:

1. A halides removal washing system comprising:

a process gas duct for process gas comprising hydrocarbons and halides;

an injector pipe extending into the process gas duct, said injector pipe having a wash water inlet in a first end of the injector pipe arranged outside the process gas duct and a wash water outlet with an injector nozzle in a second end of the injector pipe adapted to spray the wash water into the process gas in the process gas duct downstream of the injector nozzle, wherein mixing of the wash water and the process gas results in washout of hydrochloric acid (HCl) at a level above 99.9%; and anti-precipitation means comprising electrical heating wiring arranged around at least a part of the injector pipe which extends into the process gas duct, and an injector purge channel arranged around the injector nozzle and adapted to provide a relatively hot injector purge fluid as compared to the temperature of the wash water, wherein the process gas duct has an anti-corrosion liner arranged on the inside surface of the process gas duct downstream of the injector nozzle, wherein the anti-corrosion liner is arranged with a gap between the inside surface of the process gas duct and the anti-corrosion liner allows for a duct purge fluid between the anti-corrosion liner and the process gas duct, and further comprising: (1) a sealing provided between the anti-corrosion liner and the process gas duct such that the process gas does not enter the gap, and (2) a purge fluid connection to the process gas duct downstream of the injector nozzle adapted to purge fluid into the gap between the anti-corrosion liner and the process gas duct; and wherein the halides removal washing system prevents precipitation of ammonium chloride ($NH_4Cl$).

2. The halides removal washing system of claim 1, wherein gap is from 0.2-50 mm between the inside surface of the process gas duct and the anti-corrosion liner.

3. The halides removal washing system of claim 1, further comprising a duct purge fluid consumption monitoring system adapted to provide an alarm output if the duct purge fluid consumption exceeds a pre-set value.

4. The halides removal washing system of claim 1, further comprising at least one fluid mixer element arranged within the process gas duct downstream the injector nozzle.

5. The halides removal washing system of claim 1, further comprising a plurality of injector pipes and a plurality of injector nozzles.

6. The halides removal washing system of claim 5, further comprising:

a common process gas duct upstream the injector nozzles; and a plurality of process gas ducts downstream each of the injector nozzles.

* * * * *